US006730867B2

(12) United States Patent
Hyp

(10) Patent No.: US 6,730,867 B2
(45) Date of Patent: May 4, 2004

(54) ELECTRICALLY OPERATED RATCHETING PAWL LATCH

(75) Inventor: Eric D. Hyp, Aspers, PA (US)

(73) Assignee: Southco, Inc., Concordville, PA (US)

( * ) Notice: Subject to any disclaimer, the term of this patent is extended or adjusted under 35 U.S.C. 154(b) by 300 days.

(21) Appl. No.: 09/900,592

(22) Filed: Jul. 6, 2001

(65) Prior Publication Data

US 2004/0012468 A1 Jan. 22, 2004

Related U.S. Application Data

(60) Provisional application No. 60/216,752, filed on Jul. 7, 2000.

(51) Int. Cl.[7] ..... H01H 9/00

(52) U.S. Cl. ..... 200/318; 200/320; 200/50.01

(58) Field of Search ..... 200/318, 318.2, 200/320, 321, 323, 325, 327, 50.01, 50.03, 50.08, 50.3, 50.34, 50.37

(56) References Cited

U.S. PATENT DOCUMENTS

| | | | | |
|---|---|---|---|---|
| 3,918,754 A | | 11/1975 | Ibister | |
| 4,760,224 A | * | 7/1988 | Genba | 200/400 |
| 4,838,056 A | | 6/1989 | Weinerman et al. | |
| 4,850,208 A | | 7/1989 | Weinerman et al. | |
| 4,911,487 A | | 3/1990 | Rachocki | |
| 4,969,916 A | | 11/1990 | Weinerman et al. | |
| 4,979,384 A | | 12/1990 | Malesko et al. | |
| 4,989,907 A | | 2/1991 | Edmonds et al. | |
| 5,020,838 A | | 6/1991 | Fukumoto | |
| 5,046,340 A | | 9/1991 | Weinerman et al. | |
| 5,098,141 A | | 3/1992 | Bull | |
| 5,127,686 A | | 7/1992 | Gleason et al. | |
| 5,234,238 A | | 8/1993 | Takimoto | |
| 5,299,844 A | | 4/1994 | Gleason | |
| 5,340,174 A | | 8/1994 | Bender et al. | |
| 5,413,391 A | | 5/1995 | Clavin et al. | |
| 5,521,346 A | * | 5/1996 | Castonguay et al. | 200/401 |
| 6,005,208 A | * | 12/1999 | Castonguay | 200/308 |
| 6,116,067 A | | 9/2000 | Myers et al. | |
| 6,252,186 B1 | * | 6/2001 | Liebetruth et al. | 200/43.01 |

FOREIGN PATENT DOCUMENTS

DE 37 32 138 A 4/1988

OTHER PUBLICATIONS

Suzuki Latch (Item 1), no date.
Toyota Latch (Item 2), no date.
Nissan or Mazda Latch (Item 3), no date.
Lexus Latch (Item 4), no date.
Latch (Item 5), no date.
Nissan Latch (Item 6), no date.

* cited by examiner

*Primary Examiner*—K. Lee
(74) *Attorney, Agent, or Firm*—Paul & Paul

(57) ABSTRACT

The present invention is directed to a latch that includes a housing, a pawl pivotally supported by the housing and movable between a latched position and an unlatched position, a spring biasing the pawl toward the unlatched position, and a locking member being rotationally movable about an axis of rotation between an open position and a locked position. The locking member interferes with the movement of the pawl such that the pawl is maintained in the latched position when the pawl is in the latched position and the locking member is in the locked position. The locking member allows the pawl to move to the unlatched position when the locking member is in the open position. The latch may further include a motor housing, a lockplug, a lockplug member, at least one roller switch, at least one gearbox, and a motor.

15 Claims, 12 Drawing Sheets

FIG. 18
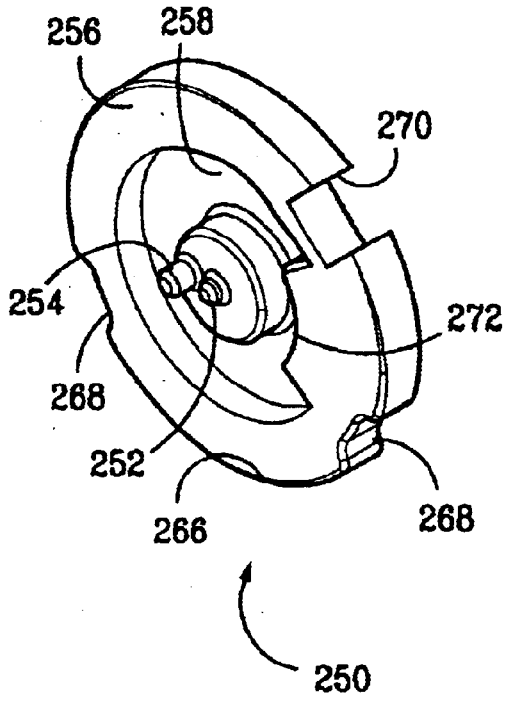
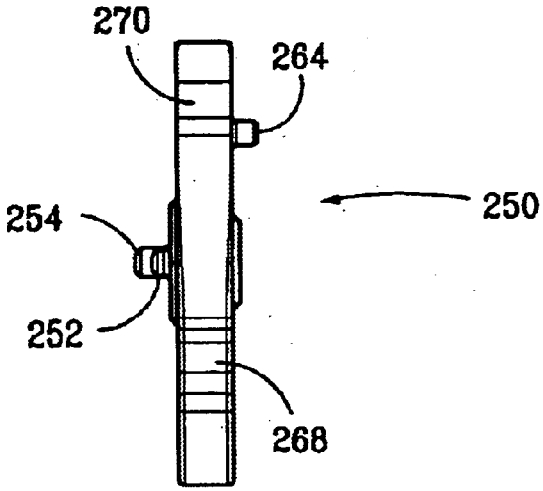
FIG. 19
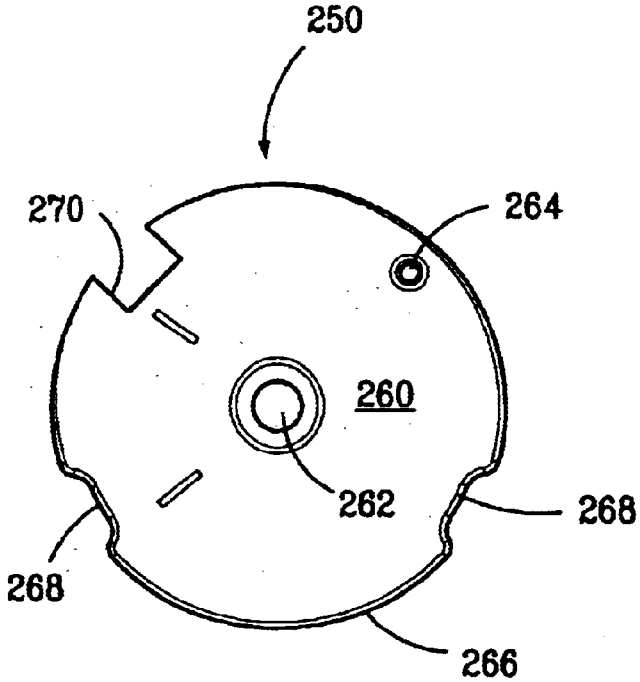
FIG. 20

ELECTRICALLY OPERATED RATCHETING PAWL LATCH

CROSS-REFERENCE TO RELATED APPLICATION

This utility patent application is based on U.S. provisional patent application No. 60/216,752, filed Jul. 7, 2000.

BACKGROUND OF THE INVENTION

1. Field of the Invention

The present invention is a latch for actuation with both an electric motor and manually.

2. Description of the Related Art

Latch assemblies are relied on in many applications for securing items, such as panels, together. For example, containers, cabinets, closets, compartments and the like may be secured with a latch. An important use for latches is in the automotive field, where there is a desire and need to access automotive compartments, such as, for example, the trunk or passenger compartments of vehicles, as well as interior compartments such as a glove box.

Various latches for panel closures have been employed where one of the panels such as a swinging door or the like is to be fastened or secured to a stationary panel or compartment body. The prior art devices generally utilize a locking member which is spring-loaded externally by one or more separately provided torsion springs. For example, some prior art devices rely upon a lock which comprises rigid metal parts and requires additional biasing members for operation of the assembly. It has been increasingly more important and desirable to provide remote features for operation of latch mechanisms which permits a user to operate the latch from a location remote of that at which the latch is installed. For example, automobile latches often rely on the use of remote devices to open and close door locks, for example, using infrared, radio, or other wireless transmission modes. In addition, vehicle trunks often are provided so that they can be unlocked by remote means to permit the raising or opening of a panel.

In furnishing remote latching mechanisms, it must be taken into account that in some instances remote means may have failures, such as, for example, due to a loss of power supply (especially where electronic circuitry is employed). It is therefore also desirable to provide additional or secondary latching capabilities in order that the latch can be locked or opened manually, should the remote mechanism fail. In some instances, capped openings are provided in the vicinity of the latch which can permit a user to access the latch to open it should the remote mechanism not be operable. However, where security is concerned, it is not practical to provide an easy means for gaining an ability to open a latch. In these instances, complex mechanisms have been employed.

It is desirable to provide a latch which can be utilized both, by a remote locking mechanism and a key operated mechanism, and furthermore, where both the remote and the key operation can be used alternately as desired by the user. That is, it is desirable to have a latch with a locking capability where either a remote locking mechanism or a manual (key type) mechanism can be used to lock or unlock the latch, regardless of which one had previously been used.

The present invention provides a novel ratcheting pawl latch with the ability to lock and unlock the latch with remote and key operated mechanisms.

SUMMARY OF THE INVENTION

The present invention is a latch that may be operated either by an electric motor, possibly remotely, or manually.

The latch includes a lockplug housing, a motor housing, a lockplug, a lockplug driver, a locking disk, a pawl, and a pair of roller switches.

The pawl includes a pair of arms and a locking disk engagement tooth. The pawl pivots between a latched and unlatched position, and is spring-biased towards its unlatched position. The pawl is dimensioned and configured to secure a wire keeper between its two arms.

The locking disk is pivotally secured between the lockplug housing and the motor housing. The locking disk defines a bearing surface around its circumference, which further defines a window dimensioned and configured to permit passage of the pawl, and a pair of cutouts. The locking disk pivots between a locked position and an open position, defining an unlocked range of positions therebetween. The locking disk is spring-biased away from the open position, but is not spring-biased in either the locked position or the unlocked range of positions. In the locked and unlocked positions, the edge of the locking disk abuts the locking disk engagement tooth of the pawl, thereby securing the pawl in its latched position. When the locking disk is rotated to the unlocked position, the window is aligned with the pawl, allowing the pawl to rotate to its unlatched position. The locking disk will then abut the pawl's locking disk engagement tooth, preventing the locking disk from rotating out of the locked position.

One side of the locking disk engages a gearbox, which in turn engages a motor. The motor is preferably a 12-volt DC motor, but is not limited to this type. The DC motor may be controlled by any of several means, including a programmable logic controller, a dashboard mounted switch, and/or a remote switch. The opposite side of the locking disk engages the lockplug driver.

The lockplug and lockplug driver turn as a single unit within the lockplug housing. The lockplug is spring-biased towards a central position. The lockplug driver engages the locking disk by means of a pin projecting from the locking disk into a slot in the lockplug driver. The slot extends for 90° around the lockplug driver. Therefore, the lockplug must be rotated 45° in either direction before engaging the locking disk. Likewise, when the motor rotates the locking disk, the locking disk is free to rotate 45° before engaging the lockplug driver. This is necessary because a force applied to rotate the lockplug will rotate the DC motor as well, but a force applied through the DC motor will have no way to rotate the lockplug.

The latch includes a pair of roller switches between the motor housing and lockplug housing. Each roller switch includes a cantilever with a roller end abutting the bearing surface of the locking disk. Depressing the cantilever closes an electrical circuit. When the roller abuts a cutout in the locking disk, the cantilever is extended, opening the circuit. Likewise, when the roller abuts the other portions of the disk's bearing surface, the cantilever is depressed. One cutout corresponds to the latch's locked position, and the other corresponds to the latch's open position. Therefore, the first of the two roller switches will be open when the latch is locked, and the second of the two roller switches will be open when the latch is open. The combined state of the two latches therefore indicates whether the latch is locked, unlocked, or open. This signal can be directed to a programmable logic controller (PLC), which, given the current state of the latch, and the desired state of the latch from a remote controller, will turn the motor the proper amount to bring the latch into the desired state. For example, if the latch is unlocked (both roller switches closed) and the user switches the latch to open, the PLC will rotate the motor until the second roller switch engages the corresponding cutout in the locking disk and opens. The PLC will then receive a signal that the latch is open, and stop rotating the motor.

It is a principal object of the present invention to provide a novel latch assembly which is selectively engagable with a keeper member, and includes a spring locking member which is spring-loaded with its own spring force for engaging and releasing a pawl from a keeper member when a handle is actuated.

It is another object of the present invention to provide a locking member which is comprised of spring steel or plastic.

It is another object of the present invention to provide a latch assembly with a locking component which can be operated with a key or other operator, such as radio, infrared, electronic or other means, which selectively engages the locking member against movement.

It is another object of the present invention to provide a latch assembly with a locking mechanism which can be operated with a key or other operator, such as, a solenoid controller, where the key and solenoid control the same locking element but provide independent ways to lock and unlock the latch.

These and other objects of the invention will become apparent through the following description and claims.

BRIEF DESCRIPTION OF THE DRAWINGS

FIG. 18 is a perspective view of a locking disk for an electrically operated ratcheting pawl latch according to the present invention.

FIG. 19 is a side view of a locking disk for an electrically operated ratcheting pawl latch according to the present invention.

FIG. 20 is a rear view of a locking disk for an electrically operated ratcheting pawl latch according to the present invention.

Like reference numbers denote like elements throughout the drawings.

DETAILED DESCRIPTION OF THE PREFERRED EMBODIMENTS

Figure 1:
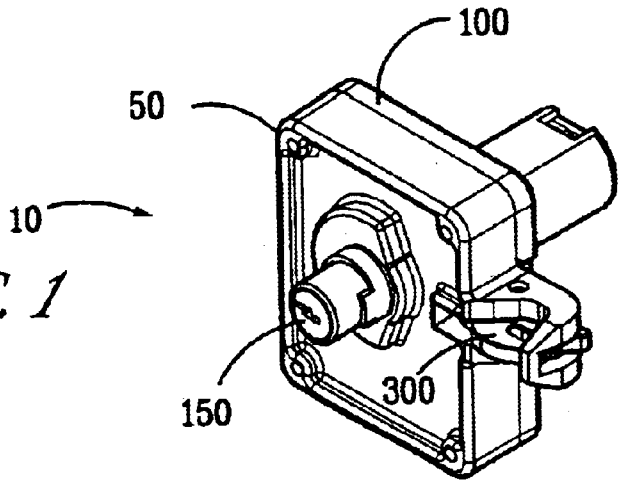
FIG. 1 is a perspective view of an electrically operated ratcheting pawl latch according to the present invention.
Figure 2:
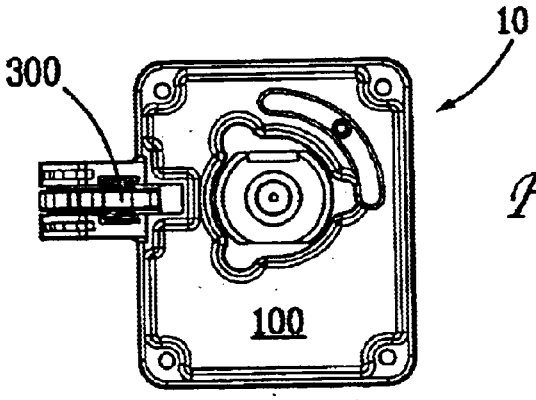
FIG. 2 is a rear view of an electrically operated ratcheting pawl latch according to the present invention.
Figure 3:
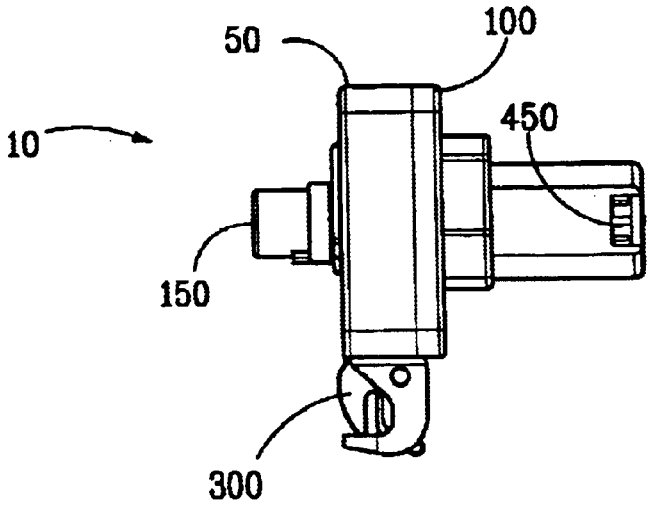
FIG. 3 is a side view of an electrically operated ratcheting pawl latch according to the present invention.
Figure 4:
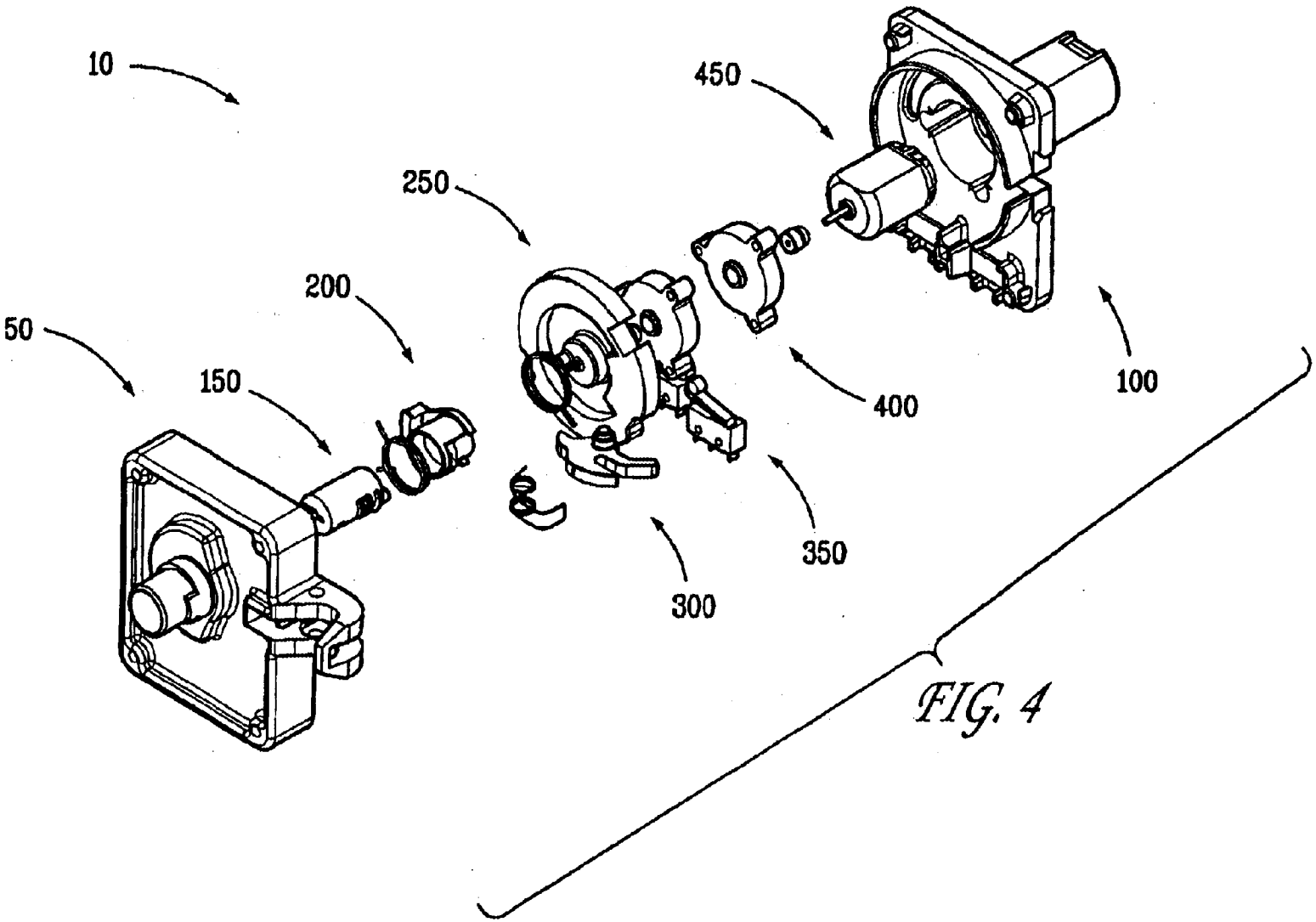
FIG. 4 is an exploded perspective view of an electrically operated ratcheting pawl latch according to the present invention.
Figure 5:
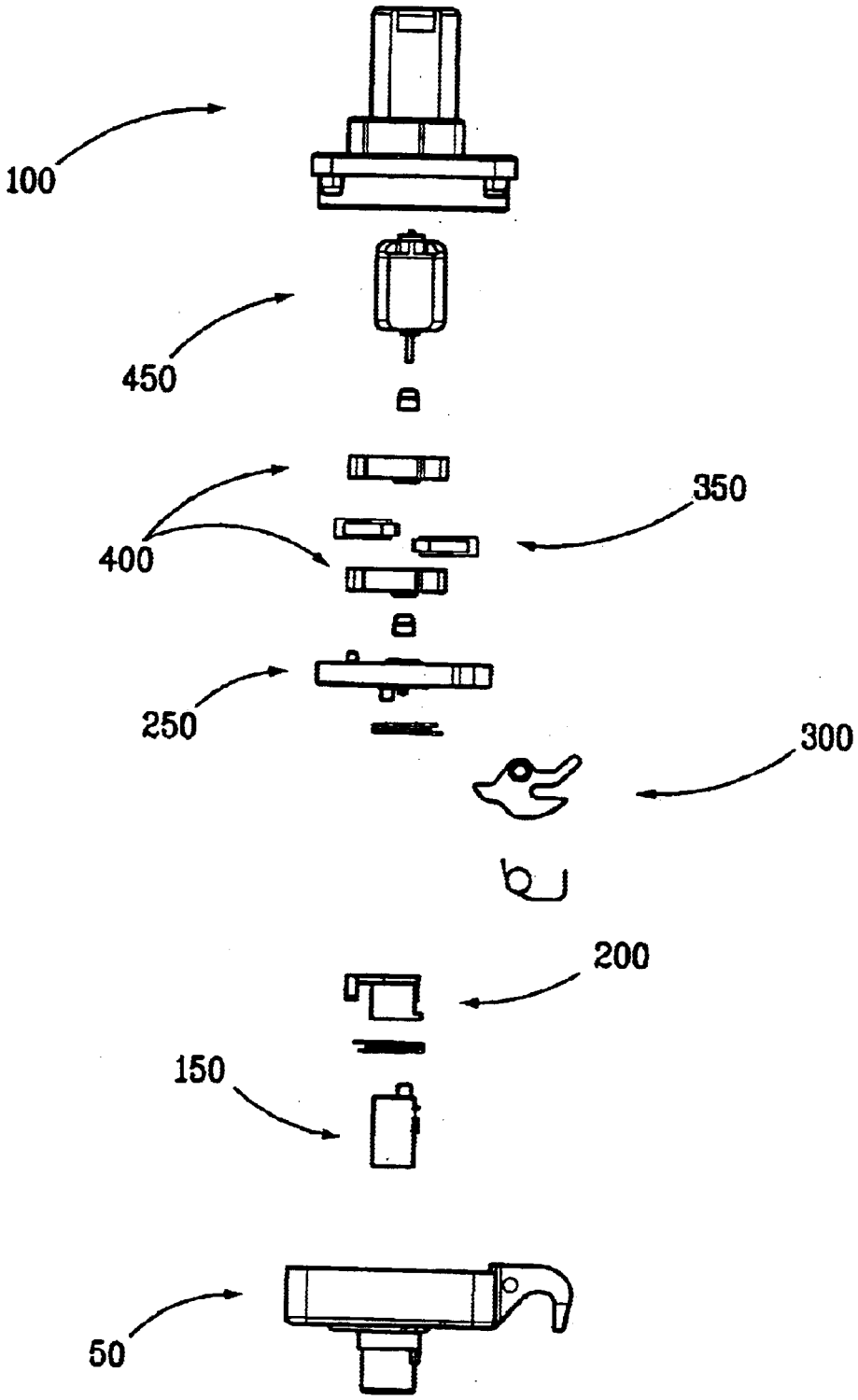
FIG. 5 is an exploded side view of an electrically operated ratcheting pawl latch according to the present invention.

The invention is an electrically operated ratcheting pawl latch. Referring to FIGS. 1–5, the latch 10 includes a lockplug housing 50, a motor housing 100, a lockplug 150, a lockplug driver 200, a locking disk 250, a pawl 300, a pair of roller switches 350, at least one gearbox 400, and a motor 450.

Figure 6:
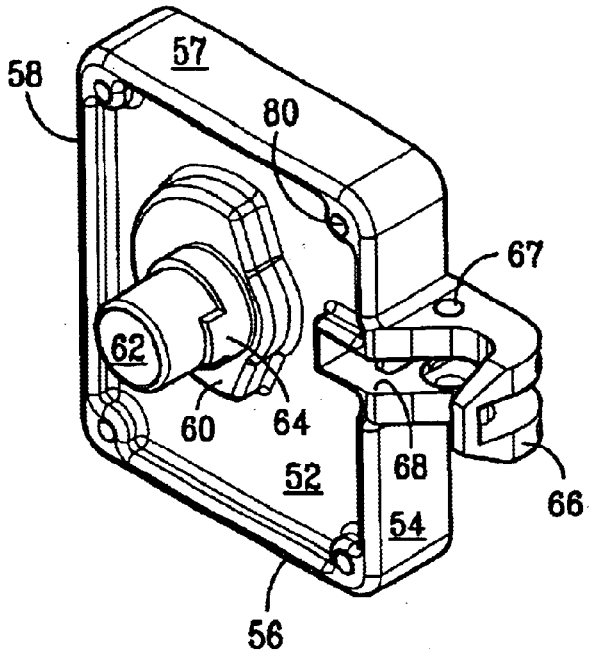
FIG. 6 is a perspective view of a lockplug housing for an electrically operated ratcheting pawl latch according to the present invention.
Figure 7:
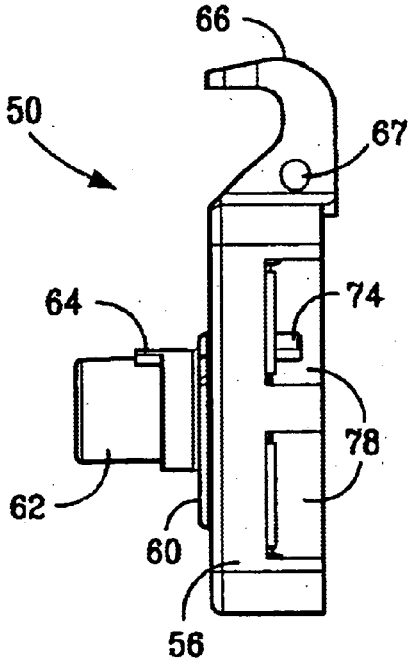
FIG. 7 is a bottom view of a lockplug housing for an electrically operated ratcheting pawl latch according to the present invention.
Figure 8:
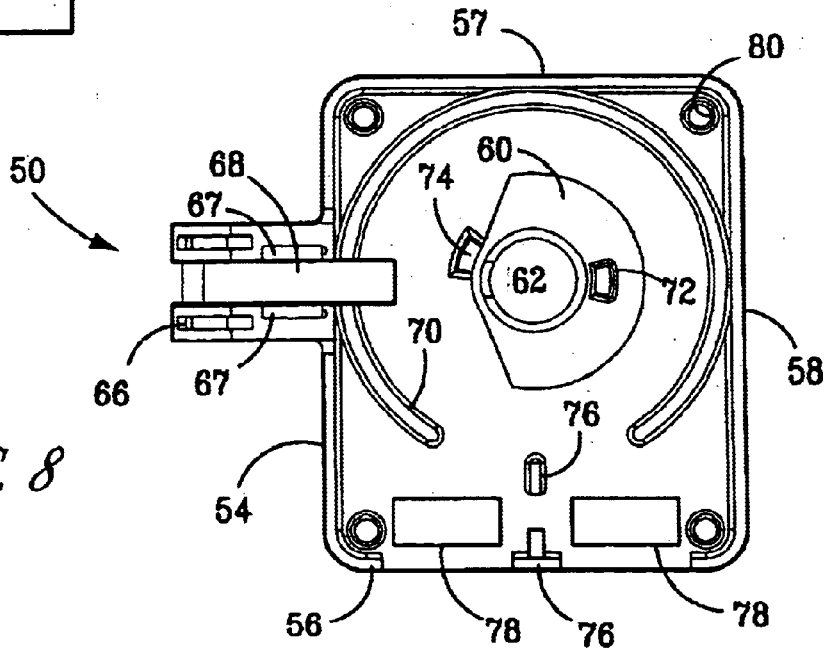
FIG. 8 is a rear view of a lockplug housing for an electrically operated ratcheting pawl latch according to the present invention.

Referring to FIGS. 6–8, the lockplug housing 50 is illustrated. The lockplug housing 50 includes a front 52, a bottom 54, a pair of sides 56, 57, and a top 58. The front 52 defines a channel 60 dimensioned and configured to receive a lockplug driver 200 (described below) and a cylinder 62 dimensioned and configured to receive a lockplug 150. The cylinder 62 defines a recess 64 for receiving a plurality of locking wafers of the lockplug 150 (described below). A pawl nest 66 protrudes from the bottom 54, and a window 68, dimensioned and configured to receive a pawl 300 (described below), is defined in that portion of the bottom 54 within the pawl nest 66. The pawl nest 66 preferably includes a pair of coaxial apertures 67. Referring specifically to FIG. 8, illustrating the rear or inside portion of the lockplug housing 50, a locking disk wall 70 is illustrated surrounding the channel 60. A lockplug torsion spring driving tooth 72 is defined within the channel 60, adjacent to the cylinder 62. A locking disk torsion spring tooth 74 is defined opposite the tooth 72, adjacent to the cylinder 62 but outside the channel 60. Adjacent to one side 56, a plurality of risers 76 is positioned for retaining a pair of roller switches 350 (described below). The side 56 defines a pair of windows 78 for permitting access to the contacts on the roller switches 350, best seen in FIG. 7. The lockplug housing 50 preferably includes a plurality of mounting holes 80 for securing the lockplug housing 50 to the motor housing 100.

Figure 9:
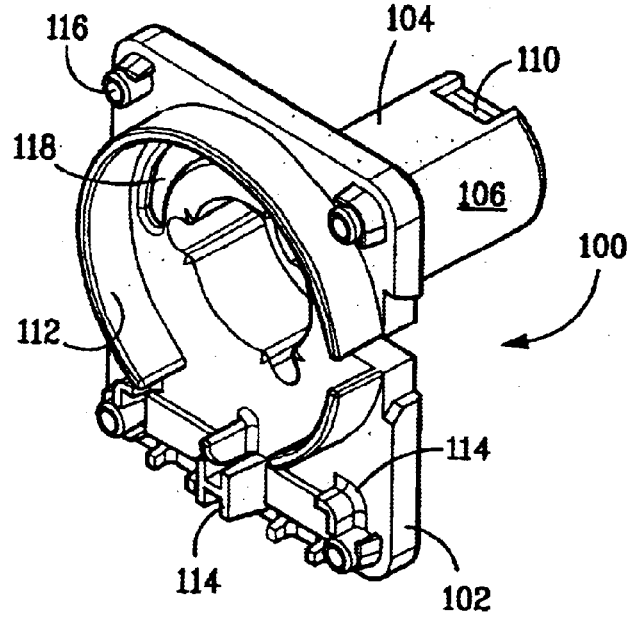
FIG. 9 is a perspective view of a motor housing for an electrically operated ratcheting pawl latch according to the present invention.
Figure 10:
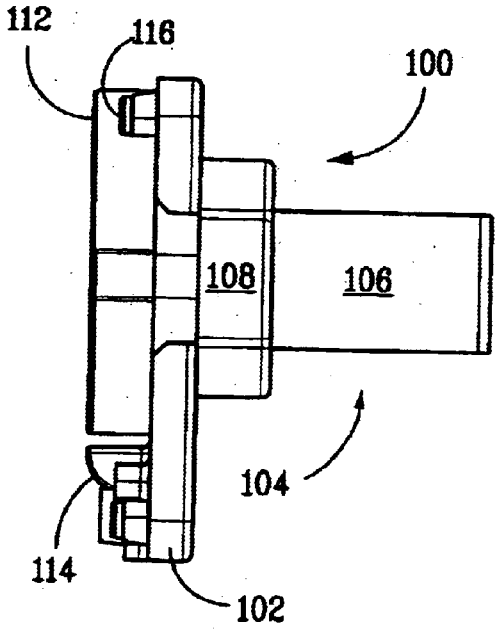
FIG. 10 is a side view of a motor housing for an electrically operated ratcheting pawl latch according to the present invention.
Figure 11:
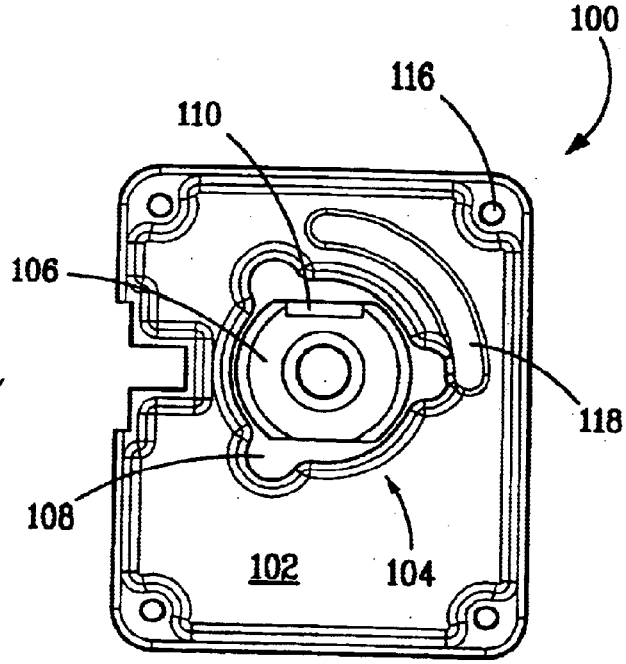
FIG. 11 is a rear view of a motor housing for an electrically operated ratcheting pawl latch according to the present invention.

The motor housing 100 is best illustrated in FIGS. 9–11. The motor housing 100 includes a panel 102, from which a rearward portion 104 extends. The rearward portion 104 defines a motor-containing portion 106 and a gearbox-containing portion 108. The motor-containing portion 106 preferably includes a window 110 for passage of the electrical contacts to the motor 450. The opposite side of the panel 102 includes a perimeter wall 112, dimensioned and configured to contain the locking disk 250. The motor housing 100 includes risers 114, dimensioned and configured to secure the roller switches 350 in place. A guide slot 118 is defined around a 90° section of the perimeter wall 112. The panel 102 preferably includes mounting holes 116 for securing the motor housing 100 to the lockplug housing 50.

Figure 12:
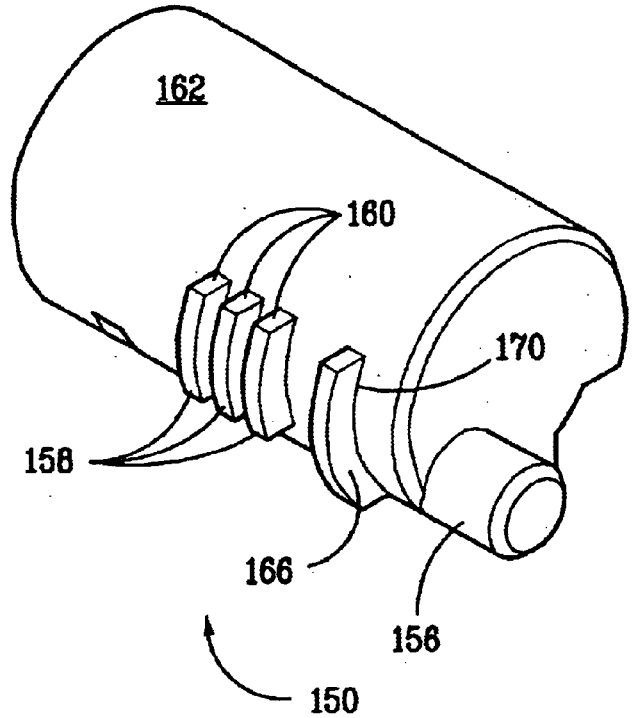
FIG. 12 is a perspective view of a lockplug for an electrically operated ratcheting pawl latch according to the present invention.
Figure 13:
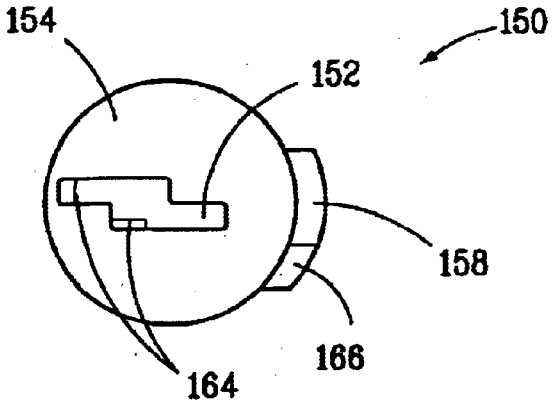
FIG. 13 is a front view of a lockplug for an electrically operated ratcheting pawl latch according to the present invention.
Figure 14:
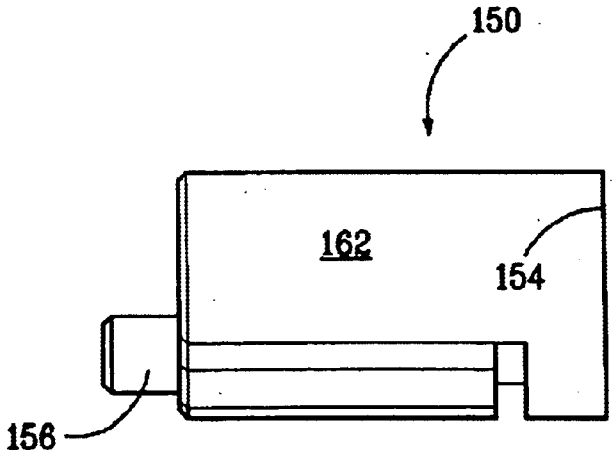
FIG. 14 is a side view of a lockplug for an electrically operated ratcheting pawl latch according to the present invention.

A lockplug 150 is illustrated in FIGS. 12–14. The lockplug 150 includes a key slot 152 within its front end 154. The rear of lockplug 150 may include a peg 156. A plurality of wafers 158 extends from slots 160 within the side wall 162 of lockplug 150. When a key is inserted and engages tumblers 164, the wafers 158 are retracted. Likewise, removing the key extends the wafers 158. A retention wafer 166 is spring-biased outward from a slot 168 within the side wall 162.

Figure 15:
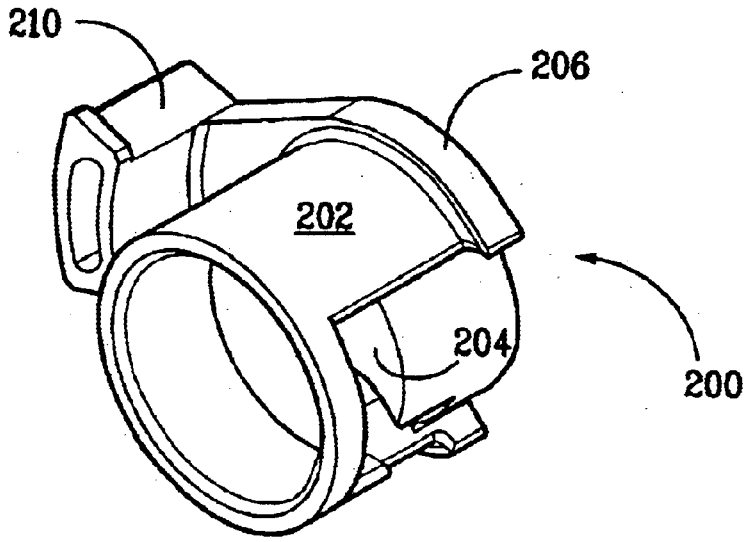
FIG. 15 is a perspective view of a lockplug driver for an electrically operated ratcheting pawl latch according to the present invention.
Figure 16:
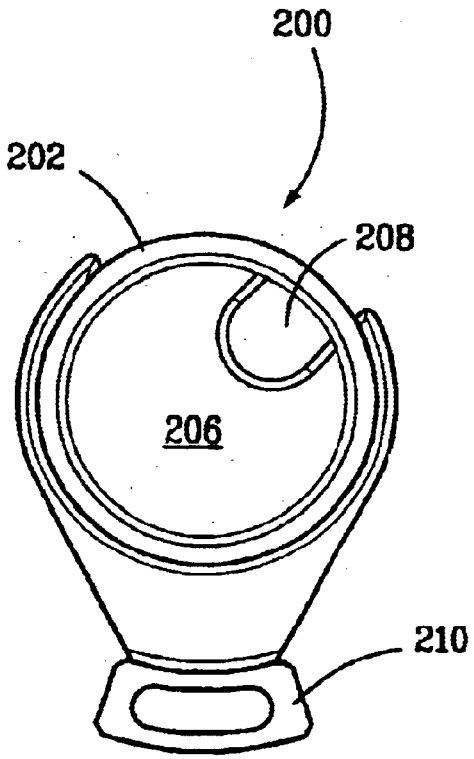
FIG. 16 is a front view of a lockplug driver for an electrically operated ratcheting pawl latch according to the present invention.
Figure 17:
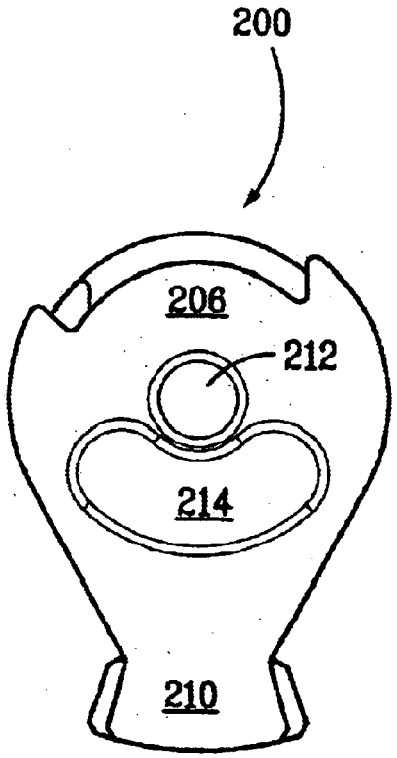
FIG. 17 is a rear view of a lockplug driver for an electrically operated ratcheting pawl latch according to the present invention.

A lockplug driver 200 is illustrated in FIGS. 15–17. The lockplug driver 200 includes a cylinder 202, dimensioned and configured to receive the lockplug 150. The cylinder 202 includes a slot 204, dimensioned and configured to receive the retention wafer 166. The rear portion 206 includes an aperture 208, dimensioned and configured to receive the lockplug's peg 156. Opposite the cylinder 202, the rear portion 206 also defines a central aperture 212, and a channel 214, extending for 90° around the aperture 212. The aperture 212 is dimensioned and configured to engage a center post of the locking disk 250 (described below). The channel 214 is dimensioned and configured to engage a driver post on the locking disk 250. A spring retaining tab 210 protrudes outward to one side of the cylinder 202.

Figure 25:
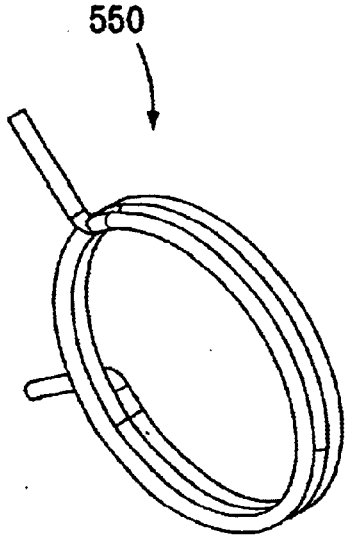
FIG. 25 is a perspective view of a torsion spring for an electrically operated ratcheting pawl latch according to the present invention.

The lockplug 150 is inserted into the lockplug driver 200 so that the retention wafer 166 engages the slot 204, and the peg 156 engages the aperture 208. In use, the lockplug 150 and lockplug driver 200 will rotate as a single unit, and will be biased towards the position wherein the wafers 158 will engage the recess 64. The means for biasing the lockplug 150 and lockplug driver 200 is preferably a spring such as the spring 550 illustrated in FIG. 25.

Figure 24:
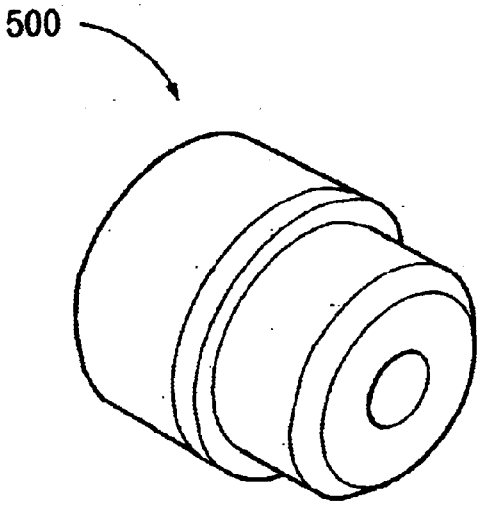
FIG. 24 is a perspective view of a sungear for an electrically operated ratcheting paw latch according to the present invention.

The locking disk 250 is best illustrated in FIGS. 18–20. The locking disk 250 includes a central post 252 and a driver post 254 on its front face 256. The front face 256 also defines a cavity 258, dimensioned and configured to receive a spring and the locking disk torsion spring tooth 74 of the lockplug housing 50. A spring retention feature 272 is also defined within the cavity 258. The rear face 260 includes an aperture 262, dimensioned and configured to receive a sungear 500 (illustrated without teeth in FIG. 24), and a deadstop lug 264, dimensioned and configured to engage the slot 118 within the motor housing 100. The locking disk's circumference 266 defines a bearing surface having a pair of cutouts 268, and a window 270, dimensioned and configured to receive the pawl 300.

The locking disk 250 is positioned immediately behind the lockplug driver 200, with the central post 252 engaging the aperture 212, and the driver post 254 engaging the slot 214. In use, the locking disk 250 will pivot between an open position and a locked position, with an unlocked range of positions defined therebetween, and will be biased away from the open position. Preferred and suggested means for biasing the locking disk 250 away from the open position is the spring 550.

Figure 21:
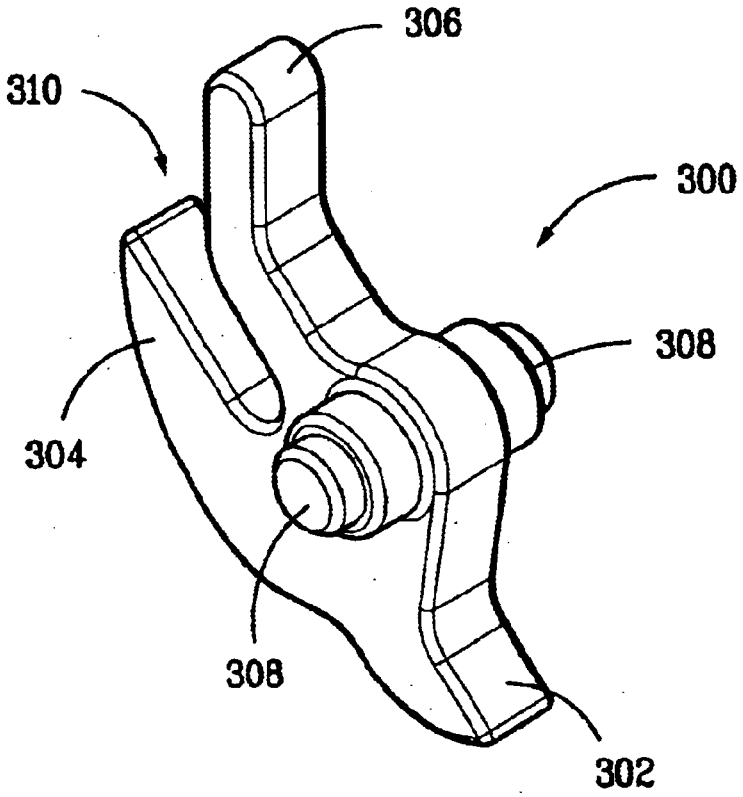
FIG. 21 is a perspective view of a pawl for an electrically operated ratcheting pawl latch according to the present invention.
Figure 22:
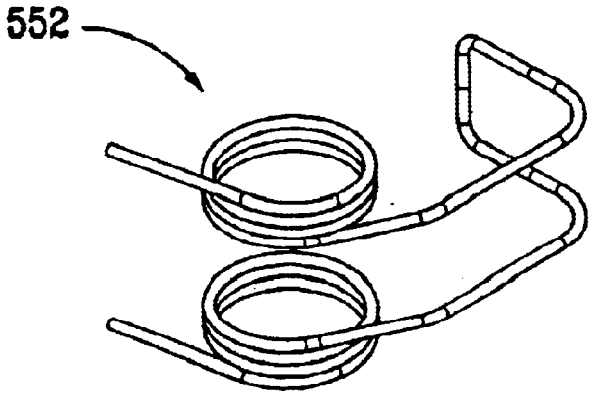
FIG. 22 is a perspective view of a pawl spring for an electrically operated ratcheting pawl latch according to the present invention.

The pawl 300 is illustrated in FIG. 21. The pawl 300 includes a locking disk engaging tooth 302, a first arm 304, and a second arm 306. The arms 304, 306 are substantially parallel and opposite the locking disk engaging tooth 302. A slot 310 is defined between arms 304, 306, and is dimensioned and configured to receive a wire keeper (not shown, and well-known). The pawl 300 also includes means for pivotally securing it within the latch 10, with preferred and suggested means being pegs 308, dimensioned and configured to mate within the apertures 67 within the pawl nest 66. With the pawl 300 secured within the apertures 67, the pawl 300 will pivot between a latched position and an unlatched position, and will be biased towards its unlatched position. Preferred and suggested means for biasing the pawl 300 towards its unlatched position are the spring 552, illustrated in FIG. 22. The locking disk 250 will abut locking disk engaging tooth 302 of the pawl 300 when the locking disk 250 is in the locked or unlocked positions. In the open position of the locking disk 250, the pawl 300 will be aligned with the window 270.

Figure 26:
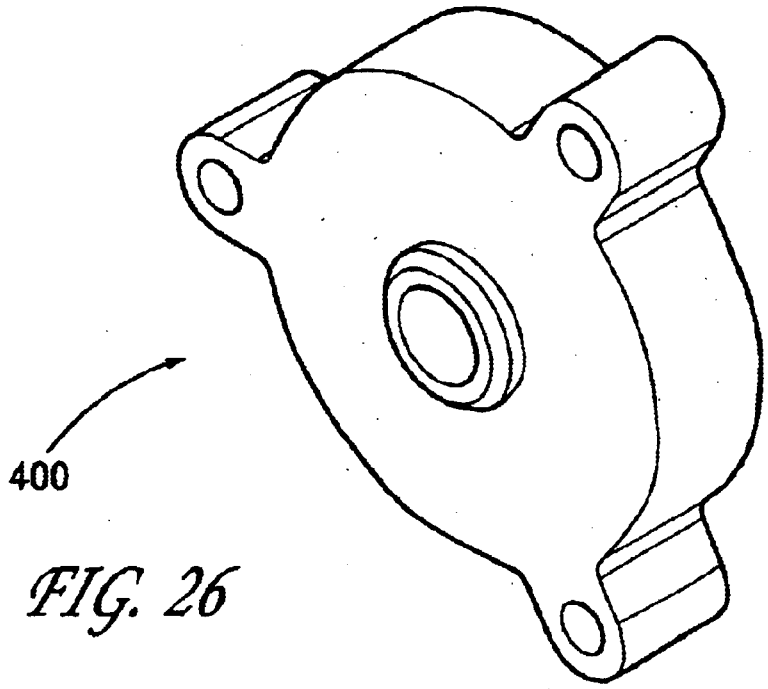
FIG. 26 is a perspective view of a gearbox for an electrically operated ratcheting paw latch according to the present invention.
Figure 27:
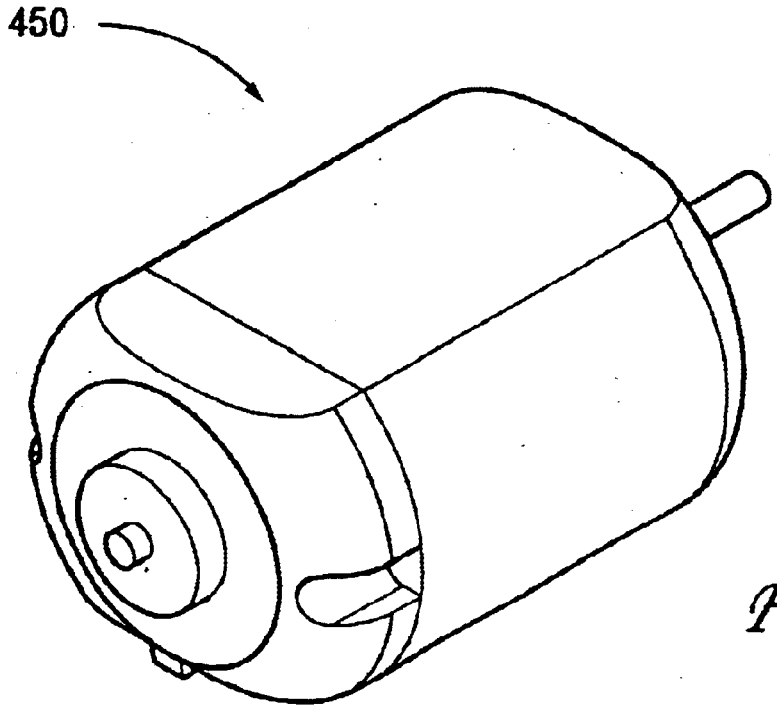
FIG. 27 is a perspective view of a motor for an electrically operated ratcheting pawl latch according to the present invention.

Located rearward of the locking disk 250 is at least one gearbox 400, illustrated in FIG. 26, and a motor 450, illustrated in FIG. 27. The gearbox 400 is preferably a planetary gearbox. The motor 450 is preferably a 12 volt DC motor. The motor 450 is located within the motor containing portion 106 of the motor housing 100, and is powered through electrical contacts passing through the window 110. The motor 450 is connected through a sungear 500 to the gearbox 400, located within the gearbox containing portion 108 of the motor housing 100. The gearbox 400 is connected to the locking disk 250 by a second sungear 500, fitting within the aperture 262.

Figure 23:
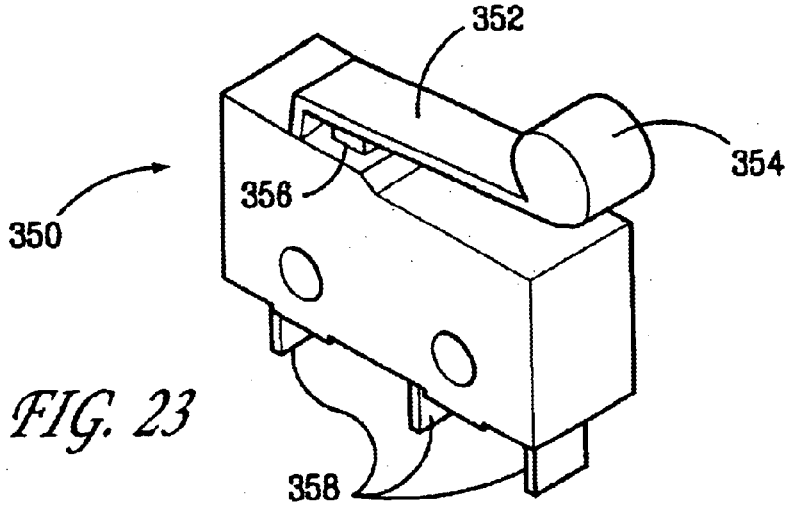
FIG. 23 is a perspective view of a roller switch for an electrically operated ratcheting pawl latch according to the present invention.

Referring to FIG. 23, a roller switch 350 is illustrated. Roller switch 350 includes a cantilever 352, terminating in a roller 354. A contact 356 is located beneath the cantilever 352, so that depressing cantilever 352 closes an electrical circuit, and releasing cantilever 352 opens the circuit. Electrical contacts 358 allow connection of the roller switch 350 to an electrical circuit. Each of the two roller switches 350 is located adjacent to the locking disk 250, so that the roller 354 abuts the locking disk's bearing surface 266. The contacts 358 are adjacent to the windows 78. Cantilever 352 is depressed unless the roller 354 has engaged one of the cutouts 268. Therefore, the cantilever 352 of the roller switch 350*a* is released when the locking disk 250 is in the locked position, and the cantilever 352 of the roller switch 350*b* is released when the locking disk 250 is in the open position. Both cantilevers 352 are depressed when the locking disk 250 is in the unlocked position. Therefore, a distinct signal is generated designating the locking disk's locked, unlocked, and open positions.

Figure 29:
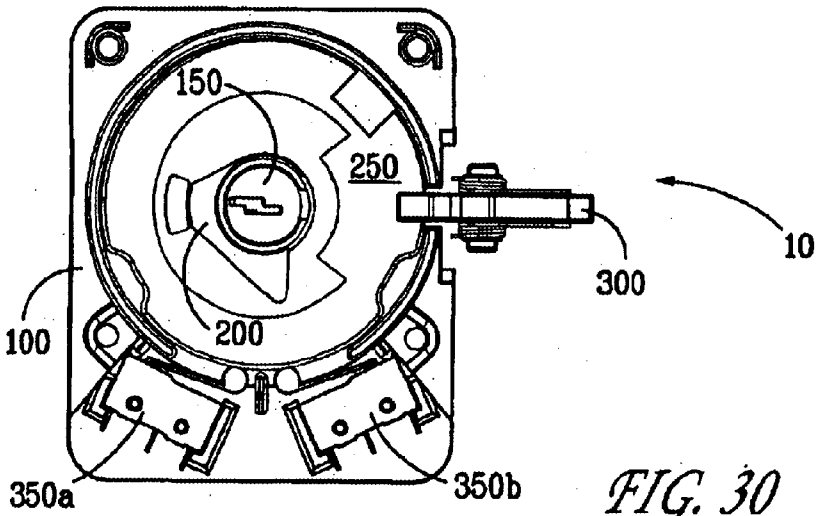
FIG. 29 is a perspective view of an electrically operated ratcheting pawl latch according to the present invention, showing the latch unlocked.
Figure 30:
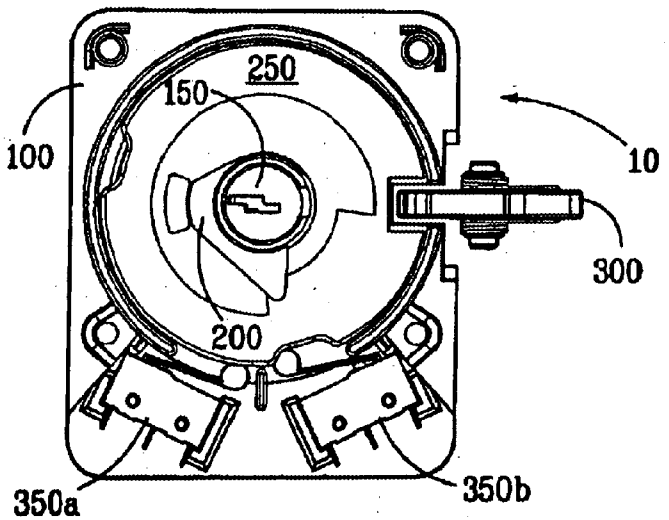
FIG. 30 is a perspective view of an electrically operated ratcheting pawl latch according to the present invention, showing the latch open.
Figure 28:
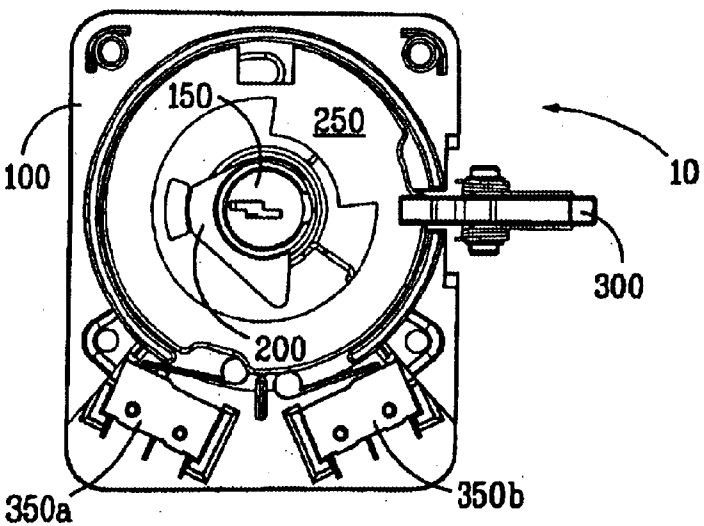
FIG. 28 is a perspective view of an electrically operated ratcheting pawl latch according to the present invention, showing the latch locked.

Operation of the latch 10 is best illustrated in FIGS. 28–30. The latch 10 may be operated either manually or by the motor 450. In the locked position, illustrated in FIG. 28, the locking disk 250 is rotated so that the window 270 is 90° to the pawl 300, the roller switch 350 engages one cutout 268 so that it is open, and the deadstop lug 264 is at one end of the slot 118. The keeper is secured between the pawl's arm 304 and the pawl nest 66. The pawl's locking disk engaging tooth 302 abuts the locking disk 250, thereby securing the pawl 300 in the latched position.

To operate the latch 10 manually, a key is first inserted into the key slot 152 of the lockplug 150. The wafers 158 retract as the key is inserted, allowing the lockplug 150 to rotate. The key is rotated clockwise. The lockplug driver 200 will engage the driver post 254, rotating the locking disk 250. If merely unlocking the latch 10 is desired, the rotation may stop anywhere in the unlocked range, such as illustrated in FIG. 29. As the locking disk 250 is rotated from the locked to the unlocked positions, the cantilever 352 of roller switch 350*a* is depressed, so that both roller switches 350 are closed. The pawl 300 remains secured in the latched position.

Once the locking disk 250 is rotated to the unlocked position illustrated in FIG. 30, the window 270 is adjacent to pawl 300, thereby permitting the pawl 300 to rotate from the latched to the unlatched position, releasing the keeper. The deadstop lug 264 reaches the opposite end of slot 118, preventing further rotation of the locking disk 250. The cantilever 352 of roller switch 350*b* is released, opening the roller switch 350*b*. As force is released from the key, the lockplug 150 and lockplug driver 200 rotate under spring pressure to their central position wherein the wafers 158 engage the recess 64, allowing removal of the key. The locking disk 250 will be spring-biased away from the open position, but will be secured in the open position by abutting pawl 300.

The latch may be closed by merely slamming it shut. The keeper will push against the arm 306 of the pawl 300, thereby rotating the pawl 300 into the latched position. Once the pawl 300 is in the latched position, the keeper will be secured between the pawl nest 66 and pawl's arm 304. The locking disk 250 is now free to rotate to the unlocked position of FIG. 29 under spring pressure. Both roller switches 350 are depressed, signaling the latch's unlocked position.

To manually move the locking disk 250 from the unlocked position to the locked position, a key is first inserted into the key slot 152 of the lockplug 150. The wafers 158 retract as the key is inserted, allowing the lockplug 150 to rotate. The key is rotated counterclockwise. For the first 45° of rotation, the lockplug driver 200 will rotate without engaging the driver post 254. For the second 45° of rotation, the end of slot 214 will abut the driver post 254, so that the lockplug driver 200 will rotate the locking disk 250. Once the locked position is reached, the deadstop lug 264 reaches the end of slot 118, preventing further rotation of the locking disk 250. The cantilever 352 of roller switch 350*a* is released, opening the roller switch 350*a*. As force is released from the key, the lockplug 150 and lockplug driver 200 rotate under spring pressure to their central position wherein the wafers 158 engage the recess 64, allowing removal of the key.

Operation of the latch using the motor 450 is accomplished through a combination of switches indicating the desired action of the user, and the signals from the roller switches 350*a*, 350*b* indicating the present state of the latch 10. These inputs can, for example, be directed to a programmable logic controller (PLC) which then controls the flow of electricity to the motor 450. The following illustration assumes a dashboard mounted switch for moving the locking disk 250 between the unlocked and open positions only, and a remote key switch for moving the locking disk 250 between the locked and unlocked positions.

When the latch 10 is unlocked, both roller switches 350*a*, 350*b* will be closed. When the PLC receives a signal from either switch instructing it to open the latch 10, it will activate the motor 450 until the roller switch 350*b* is open, signaling that the latch 10 is now open. When the PLC receives a signal from the key switch instructing it to lock the latch 10, it will activate the motor 450, supplying power to rotate the motor 450 in the opposite direction, until the roller switch 350*a* is open, signaling that the latch 10 is locked.

When the latch 10 is locked, and the PLC receives a signal from the dashboard switch instructing it to open the latch 10, the PLC will not open the latch 10, because the roller switches 350*a*, 350*b* will signal that the latch 10 is locked.

When the latch 10 is locked, and the PLC receives a signal from the key switch instructing it to unlock the latch 10, the PLC will activate the motor 450 until the roller switch 350*a* is closed. Similarly, when the latch 10 is locked, and the PLC receives a signal from the key switch instructing it to open the latch 10, it will actuate the motor 450 until the roller switch 350*b* is open.

Any time the latch 10 is manually operated, the motor 450 will simply rotate with the locking disk 250 as the force is transmitted through the gearbox 400. However, throughout electronic operation of the latch 10, the driver post 254 will move within the slot 214 without ever rotating the lockplug driver 200 or lockplug 150.

It is to be understood that the invention is not limited to the preferred embodiments described herein, but encompasses all embodiments within the scope of the following claims.

What is claimed is:

1. A latch comprising:

a housing;

a pawl pivotally supported by said housing, said pawl being movable between a latched position and an unlatched position;

biasing means biasing said pawl toward said unlatched position; and a locking member rotationally supported relative to said housing, said locking member being rotationally movable about an axis of rotation between an open position and a locked position, said locking member interfering with movement of said pawl such that said pawl is maintained in said latched position when said pawl is in said latched position and said locking member is in said locked position, said locking member allowing said pawl to move to said unlatched position when said locking member is in said open position.

2. The latch according to claim 1, further comprising a lockplug supported for selective rotation relative to said housing, said lockplug being operationally linked to said locking member to selectively cause rotation of said locking member about said axis of rotation.

3. The latch according to claim 2, further comprising a lockplug member adapted for receiving said lockplug.

4. The latch according to claim 3, further comprising a second biasing means biasing said lockplug and said lockplug member.

5. The latch according to claim 4, wherein said second biasing means is a spring.

6. The latch according to claim 3 wherein said lockplug member includes a biasing retaining tab protruding outward from one side of said lockplug member.

7. The latch according to claim 2, wherein said lockplug is biased towards a central position.

8. The latch according to claim 2, wherein said lockplug includes a key slot.

9. The latch according to claim 1, wherein said pawl is biased towards said unlatched position.

10. The latch according to claim 1, wherein said locking member is biased away from said open position.

11. The latch according to claim 1, wherein said biasing means is a spring.

12. The latch according to claim 1, further comprising at least one switch, said switch including a cantilever wherein said cantilever makes contact with said locking member and moves about a depressed position and a released position as said locking member rotatably moves about said open position and said locked position.

13. The latch according to claim 12, wherein said cantilever terminates in a roller and said roller makes contact with said locking member.

14. The latch according to claim 12, wherein said housing includes at least one riser positioned for retaining said at least one switch.

15. The latch according to claim 1, wherein said pawl includes a locking member engaging tooth, a first arm, a second arm, and slot defined between said arms, said arms are generally parallel and opposite said locking member engaging tooth, said slot is dimensioned and configured to receive a keeper.

* * * * *